United States Patent [19]

Zepkowski

[11] 4,453,742

[45] Jun. 12, 1984

[54] SKI MANEUVERING APPARATUS

[76] Inventor: John Zepkowski, R.D. 2, Canton, Pa. 17724

[21] Appl. No.: 424,208

[22] Filed: Sep. 27, 1982

[51] Int. Cl.[3] ..... A63C 11/00

[52] U.S. Cl. ..... 280/818; 280/12 F; 280/21 A

[58] Field of Search ..... 280/12 R, 12 F, 12 AA, 280/21 R, 21 A, 606, 809, 818, 817

[56] References Cited

U.S. PATENT DOCUMENTS

| | | | |
|---|---|---|---|
| 1,313,502 | 8/1919 | Pangborn | 280/12 H |
| 2,593,974 | 4/1952 | Brown | 280/12 R |
| 4,357,036 | 11/1982 | Zepkowski | 280/809 |
| 4,364,575 | 12/1982 | Schlumberger | 280/12 H X |

*Primary Examiner*—Leslie J. Paperner
*Assistant Examiner*—Donald W. Underwood

[57] ABSTRACT

An apparatus for attachment to skis to assist the user to learn basic maneuvers. A bracket is pivotally connected between the front ends of the skis in such a manner that the rear ends thereof can move inwardly and outwardly, and the skis can pivot about their longitudinal axes. A vertical pole is pivotally attached to each ski at a point between the front bracket and the boot retaining means. A linkage rod having a pivotal joint interconnects the poles. The pivotal connections between the rod and poles is such that one ski can be advanced in front of the other and assume a position lower than the other.

4 Claims, 8 Drawing Figures

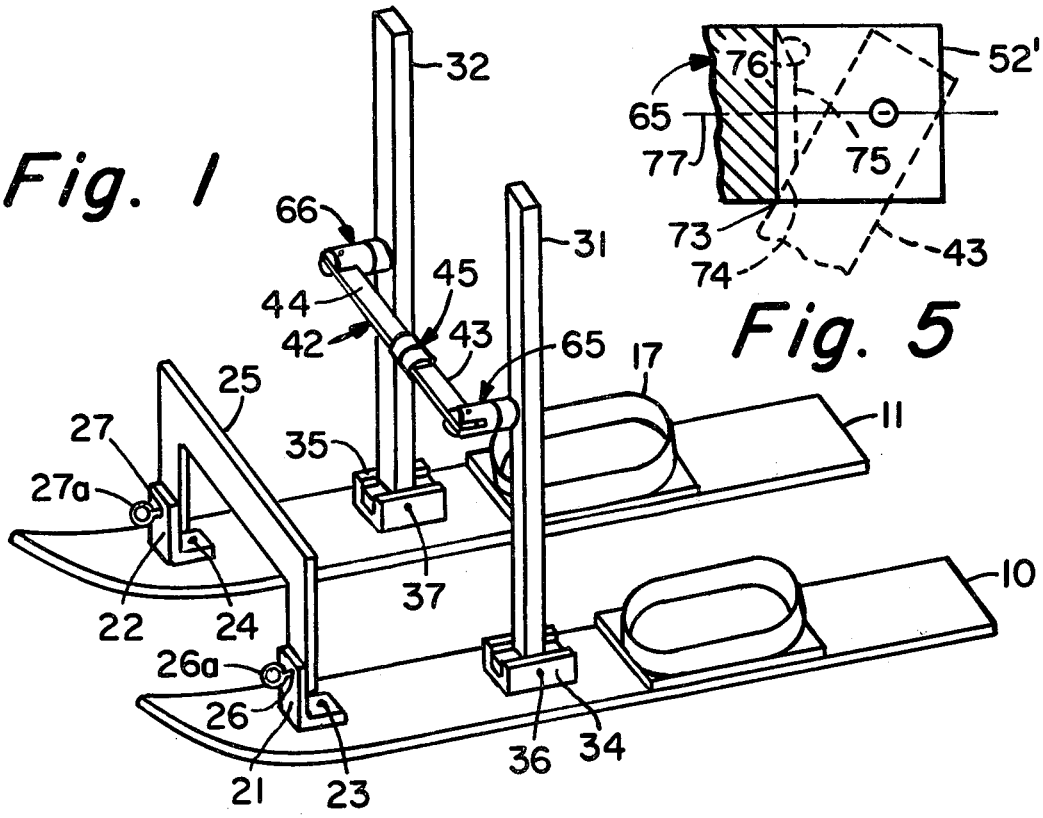
Fig. 1
Fig. 5
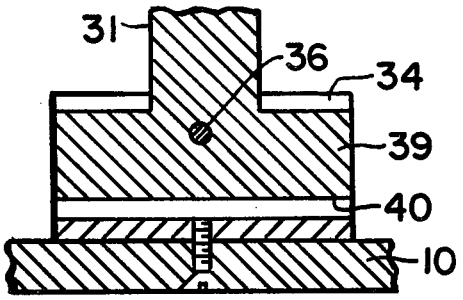
Fig. 2
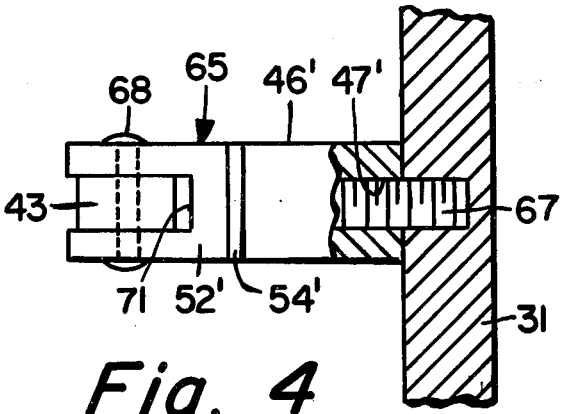
Fig. 4
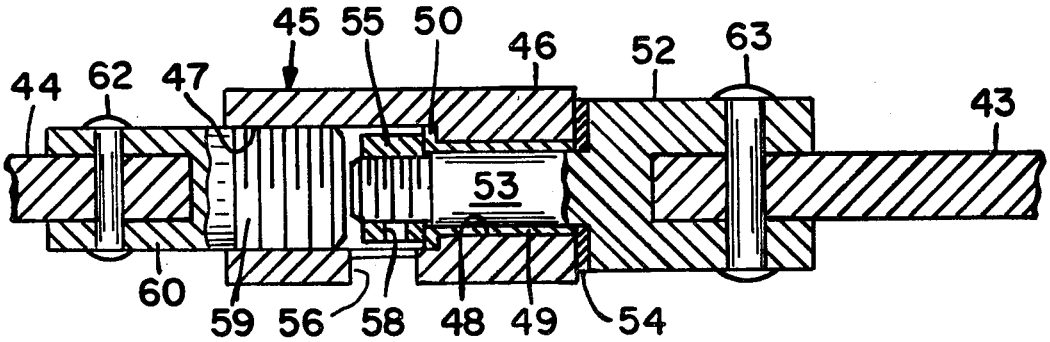
Fig. 3

SKI MANEUVERING APPARATUS

CROSS-REFERENCE TO RELATED APPLICATION

This application is related to U.S. patent application Ser. No. 184,758 filed Sept. 8, 1980.

BACKGROUND OF THE INVENTION

This invention relates to training apparatus for skis, and more particularly, to apparatus which can be attached to conventional skis to assist the user in making turns, in stopping, and in traversing a slope at an angle to the fall line.

The beginning skier must learn certain basics such as ski-to-ski spacing and the correct positioning of the skis in various maneuvers. Until the basics are learned, the beginner experiences falls and thereby is subjected to risk of injury.

Apparatus has previously been provided for interconnecting two skis and providing a handle for the skier to support himself on the resultant sled. U.S. Pat. No. 1,313,502 teaches the use of a single metal brace 3 to rigidly connect two skis in parallel. The rigidity with which the skis are maintained in a parallel relationship is reinforced by the use of standards, the tops of which are rigidly secured by a crossbar which also functions as a handle. Such skis cannot be moved from their rigidly maintained parallel relationship.

Some prior art ski interconnection brackets afford a greater degree of maneuverability. For example, French Pat. No. 803,852 teaches an apparatus including two vertical posts rigidly connected to a pair of skis for maintaining the orientation of one ski in a plane parallel to the other. French Pat. No. 2,265,693 discloses a single pivoting bracket which permits one ski to rotate with respect to the other and permits the axes of the skis to lie in non-parallel planes. French Pat. No. 1,578,848 discloses a joint which pivotally connects a rod to a ski such that the rod can move in any direction with respect to the ski.

My aforementioned related application discloses a ski interconnection apparatus, the purpose of which is to assist the beginning skier in maintaining the proper spacing between the skis while providing the skier with a manual control that assists the legs in positioning the skis. That apparatus includes brace means connected between the front portions of the skis for maintaining a given distance between the connected points while permitting the rear portions to assume a position whereby the distance between them is equal to, less than or greater than the given distance. The brace means also permits the skis to pivot about their longitudinal axes. Means is provided on each ski for retaining the boot of a person using the same. A vertical pole is attached to each of the skis at a point between the boot retaining means and the front brace. A connecting rod is pivotally connected at each end thereof to the vertical poles. Although the pivotal connections between the vertical poles and the connecting rod permitted movement of the tops of the poles toward eachother or away from eachother, that connection lacked sufficient flexibility to enable the skis to assume all of the positions in which a skier would desire to place them. More specifically, movement of one ski in front of the other was hindered.

SUMMARY OF THE INVENTION

It is therefore an object of the present invention to provide an apparatus for simplifying the learning of the basics of skiing. Another object is to provide an apparatus for enabling a beginning skier to employ his hands to assist in the correct positioning of his skis in the performance of various maneuvers. Yet another object of the present invention is to provide an apparatus for interconnecting a pair of skis in such a manner that the skis can assume all of the positions necessary for learning the art of skiing.

Briefly, the present invention relates to an apparatus for use with a pair of skis, the combination comprising the following. Brace means is connected between the front portions of the skis. This maintains a given distance between the connected points while permitting the rear portions of the skis to move freely. The brace means also permits the skier to pivot the skis about their longitudinal axes. Each ski is provided with means for retaining the boot of a person using the same. A vertical pole is attached to each of the skis at a point between the boot retaining means and the front brace. A linkage rod is pivotally connected at each end thereof to the vertical poles. The linkage rod includes rotatable joint means for enabling one end thereof to rotate freely with respect to the other end. In one embodiment the linkage rod comprises two segments joined by the rotatable joint means. In another, each end of a single rod has a rotatable joint. Each of the pivotal connections between the linkage rod and the poles preferably comprises a rotatable joint affixed at one end to its respective pole. The remaining end of the rotatable joint comprises a yoke in which an end of the linkage rod is connected.

BRIEF DESCRIPTION OF THE DRAWING

FIG. 1 is an oblique view of the apparatus of the invention.

FIG. 2 is a cross-sectional view of a bracket for pivotally connecting poles to the skis.

FIG. 3 is a cross-sectional view of a rotatable joint.

FIG. 4 is a partial cross-sectional view of a pivotal connector for attaching a linkage rod to a pole.

FIG. 5 is a cross-sectional view of a modified yoke.

DESCRIPTION OF THE PREFERRED EMBODIMENT

Figure 6:
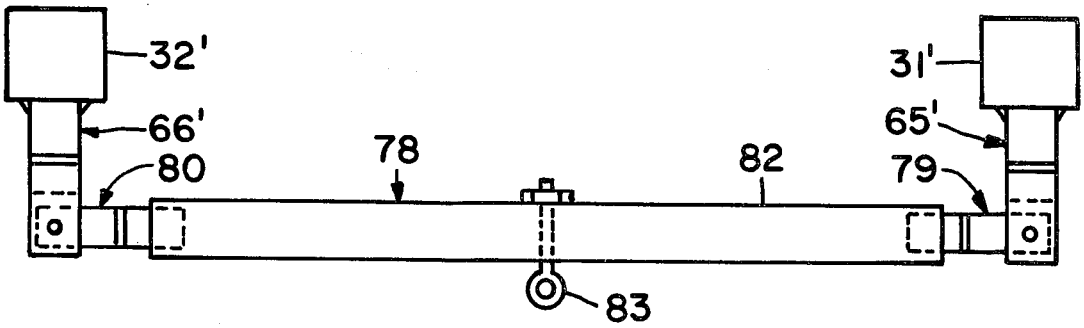
FIG. 6 is a plan view of a modified linkage rod.

Referring to FIG. 1 there is shown a pair of skis 10 and 11 having raised portions 12 and 13 which contain means 16 and 17, respectively, for retaining a boot of the user. Although any conventional binding means such as safety bindings may be utilized, there is illustrated a simple-to-use apparatus comprising ovular bands of plastic, metal or the like, which permits the user to quickly position his feet on the skis and to quickly disengage his feet in the event of a fall. A pair of such boot retainers of the size of the users boots could be affixed to the raised portions. Alternatively, a single pair of boot retainers could be employed, the length of which is adjustable.

A pair of L-shaped brackets 21 and 22 is located in the region of the skis where the tips begin to curve upward or somewhat to the rear of that region. Brackets 21 and 22 pivot about pins 23 and 24. A brace 25 is pivotally connected by pins 26 and 27 to brackets 21 and 22. Pivot pins 26 and 27 may include eye hook extensions 26a and 27a to which ropes may be attached for owing purposes. It is preferred that brace 25 be bowed or U-shaped so that it does not strike small objects on the surface of the snow. The effect of pivot pins 23 and 24 is to permit the distance between the rear ends of the skis to vary. The skis are allowed to pivot about their longitudinal axes due to the presence of pins 26 and 27.

Two poles 31 and 32 are connected to skis 10 and 11, respectively, by brackets 34 and 35 which are mounted on that region of the skis between the boot retainers and brackets 21 and 22. The poles are sufficiently long that one using the apparatus can comfortably grip the upper ends thereof. The poles can be provided with hand grips and/or wrist straps if desired. As shown in FIG. 2 each of the brackets 34 and 35 may comprise a U-channel, the bottom of which is affixed by bolts or the like to the ski. Pivot pins 36 and 37 connect poles 31 and 32 to the upright walls of the brackets. The bottom of each pole has a flanged end 39. When pole 31 is moved to its maximum forward or maximum rearward position, the bottom surface 40 of end 39 butts against the bottom of bracket 34. If desired, poles 31 and 32 could be rigidly connected to the skis as described in my aforementioned related application.

A linkage rod 42 is pivotally connected between poles 31 and 32 in the manner described below. Rod 42 may consist of two segments 43 and 44 interconnected by a rotatable joint 45 which is shown in greater detail in FIG. 3. Alternatively, linkage rod 42 may comprise a single segment, each end of which is connected to its respective pole by a rotatable joint, or a single rotatable joint could contact the single segment to one pole, no rotatable joint being necessary at the other end of the single segment.

Referring to FIG. 3 joint 45 comprises a cylindrically-shaped member 46 having a threaded axial bore 47 at one end which connects with a smaller axial bore 48 that extends to the remaining end. Sleeve 49, which is situated in bore 48, has a small flange 50 which rests on the shoulder formed between the two bores. Yoke 52 has a shaft 53 which extends through sleeve 49. A washer 54 is disposed between members 46 and 52. Both washer 54 and sleeve 49 are formed of a metal such as brass which provides a good bearing surface. A nut 55 threads onto the threaded end of shaft 53 and rests on flange 50. A window 56 in member 46 in the vicinity of the threaded end of shaft 53 permits the insertion of a tool into hole 58 in nut 55 so that it can be tightened onto the threaded shaft. At least the outer portion of bore 47 is threaded to receive the threaded portion 59 of yoke 60. Pins 62 and 63 rigidly connect segments 43 and 44 to joint 45. Joint 45 enables one of the segments 43 and 44 to rotate axially with respect to the other.

Similar rotatable joints 65 and 66 join the remaining ends of segments 43 and 44 to poles 31 and 32, respectively, as shown in FIG. 4 where elements similar to those in FIG. 3 are represented by primed reference numerals, a threaded stud 67, which extends from pole 31, screws into threaded bore 47' of member 46'. Yoke 52' rotates axially with respect to member 46'. The end of segment 43 is pivotally connected to member 65 by pin 68. This permits the movement of one of the skis to a position in front of the other. The extent of angular movement of segment 43 with respect to joint 65 is determined, inter alia, by the spacing between the segment and base 71 of yoke 52'. It may be desirable to limit this spacing and thus limit the extent of angular movement of segments 43 and 44 in order to prevent excessive movement of one ski with respect to the other, a condition which could result in loss of control.

If base 71 is flat as shown in FIG. 4 a stress point exists at the point of contact between the yoke and its respective linkage rod segment. This contact point is represented by numeral 73 in FIG. 5. To eliminate this problem the base of the yoke may be formed of three flat surfaces 74, 75 and 76, which are represented by dashed lines. Surfaces 74 and 76 are oriented non-orthogonally with respect to axis 77 of joint 65. Thus, segment 43 contacts the entire surface 74 or 76 when moved to an extreme angular position.

Figure 7:
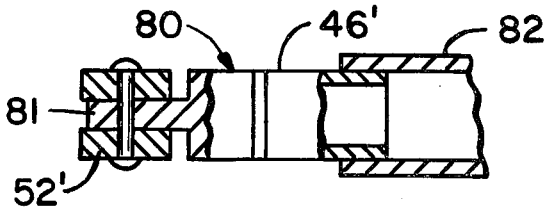
FIG. 7 is a partial cross-sectional view of a rotatable joint of the type employed in FIG. 6.

In the modified linkage rod arrangement of FIG. 6, elements similar to those of FIG. 1 are represented by primed reference numerals. Rotatable joints 79 and 80 connect the ends of tube 81 to joints 65' and 66'. In this embodiment joints 65' and 66' are welded to poles 31' and 32', respectively, a feature which adds strength to the apparatus. As shown in FIG. 7, joint 80 is similar to that shown in FIG. 3 except that the yoke is replaced by a bar 82 which extends into yoke 52'. Tube 82 extends over member 46' and is attached thereto by means such as welding, bonding material or the like. Eyebolt 83, which is secured to the center of tube 82, may be employed for towing purposes.

Figure 8:
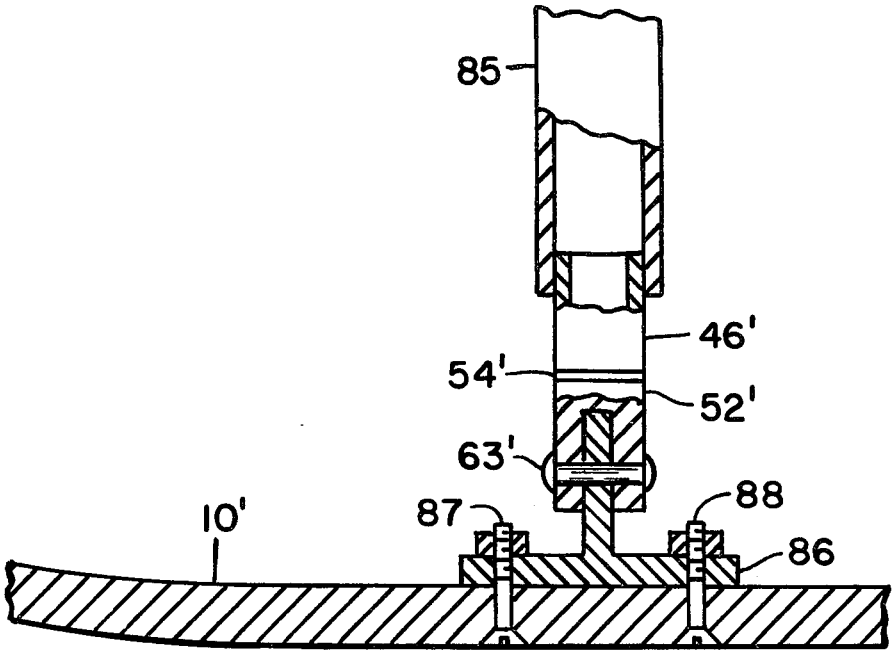
FIG. 8 shows a modified front brace connector.

Front brace 85 may be connected to the skis by a rotatable joint as shown in FIG. 8 wherein elements similar to those of FIG. 3 are represented by primed reference numerals. T-shaped bracket 86 is secured to ski 10' by any suitable means such as bolts 87 and 88. The vertical extension of bracket 86 is pivotally connected to yoke 52'. Brace 85, which in this embodiment is tubular in construction, extends over and is secured to member 46'.

The training apparatus of the present invention operates as follows. When skiing down a slope, one can slow down by pushing the tops of poles 31 and 32 toward each other. This causes the skis to pivot about pins 23 and 24 so that the rear portions thereof become separated, and the inner edges bite into the snow. This position is referred to as the snow plow position. Also, a turn will occur when the skier shifts his weight to the ski that is opposite the direction of the turn. Turning can also be accomplished by moving the pole that is opposite the direction of the turn toward the opposite pole. For example, one can turn to the left by moving the right pole to the left and shifting the weight to the right ski. When traversing a slope at an angle to the fall line, the downhill handle can be moved toward the other pole or handle which itself is maintained in an upright position. This maneuver should prevent side slipping. During the use of this apparatus, the skier may want to shift his weight forward or backward. This action is facilitated by the manner in which poles 31 and 32 are attached to the skis in the embodiment of FIGS. 1 and 2. This attachment permits the poles to move forward and backward a predetermined distance from the vertical position. Joint 45 enables the tip of one of the skis to assume a position above or below the tip of the other ski. The pivoting of segments 43 and 44 in the yokes of joints 65 and 66 enables the movement of one ski into a position in front of the other.

I claim:

1. An apparatus for use with a pair of skis, the combination comprising brace means connected between the front ends of said skis for maintaining a given distance between the connected points while permitting the rear portions of said skis to assume positions whereby the distance therebetween is equal to, greater than or less than said given distance and also permitting said skis to pivot about their longitudinal axes, means on each of said skis for retaining a foot of one skiing thereon, two vertical poles, each having a ski attachment end and a gripping end, the ski attachment end of each pole being attached to a respective one of said skis at a point between said means for retaining and the point of attachment of said brace means, linkage rod means for interconnecting said poles, means for pivotally connecting each end of said linkage rod means to a respective one of said poles, and rotatable joint means operatively connected to said linkage rod means for enabling one end thereof to rotate axially with respect to the other end thereof, whereby the front tip of one of said skis can assume a position above the front tip of the other of said skis.

2. An apparatus in accordance with claim 1 wherein said linkage rod means comprises at least two longitudinally arranged segments, said rotatable joint means being connected between two of said segments.

3. An apparatus in accordance with claim 2 wherein each of said means for pivotally connecting comprises a rotatable joint affixed to each of said poles, the end of each of said rotatable joints opposite that which is connected to said pole comprising a yoke for receiving the end of one of said segments, and means for pivotally connecting said segments to said yoke.

4. An apparatus in accordance with claim 3 wherein said rotatable joint means comprises a tubular member having a relatively large diameter axial bore extending to one end, a relatively small diameter axial bore extending to the opposite end, said bores meeting within said member to form a shoulder, a second member having a shaft extending from one end thereof, said shaft extending through said small diameter bore, the threaded end of said shaft extending into said large diameter bore, a nut on said threaded end, a washer on said shaft between said first and second members, and means at the ends of said first and second members opposite said washer for making attachment to said segments.

* * * * *